US005121672A

United States Patent [19]

Haglund

[11] Patent Number: 5,121,672

[45] Date of Patent: Jun. 16, 1992

[54] SYSTEM FOR CARRYING OUT SHELLING OF A TARGET BY MEANS OF A RAPID-FIRING ORDNANCE PIECE

[75] Inventor: Ingemar Haglund, Karlskoga, Sweden

[73] Assignee: Aktiebolaget Bofors, Bofors, Sweden

[21] Appl. No.: 544,873

[22] Filed: Jun. 28, 1990

[30] Foreign Application Priority Data

Jun. 28, 1989 [SE] Sweden ..... 8902329

[51] Int. Cl.[5] ..... F41G 3/04

[52] U.S. Cl. ..... 89/41.03; 89/41.13; 235/408; 364/423

[58] Field of Search ..... 89/27.3, 28.2, 41.03, 89/41.13; 235/408; 364/423

[56] References Cited

U.S. PATENT DOCUMENTS 3,974,740 8/1976 Billottet et al. ..... 89/41.13
4,712,181 12/1987 Dahlberg ..... 364/423
4,718,187 1/1988 Blake ..... 89/136

*Primary Examiner*—Stephen C. Bentley
*Attorney, Agent, or Firm*—Pollock, Vande Sande & Priddy

[57] ABSTRACT

A method for carrying out shelling of a target with a plurality of ammunition units fired successively from a single barrel rapid-firing ordnance piece includes supplying data to a computer means regarding the target to be shelled, generating by the computer means in response to the input data, an output data for controlling at least one of the following: the ordnance piece and the flight parameters of the respective ammunition units. The controlling of the ordnance piece and the ammunition units during firing of the successive ammunition unit from the single barrel ordnance is coordinated for imparting to the ammunition units different flight times between the ordnance piece and the target selecting the different flight times such that the ammunition units reach the target at approximately the same time after the launch from the ordnance piece.

20 Claims, 1 Drawing Sheet

SYSTEM FOR CARRYING OUT SHELLING OF A TARGET BY MEANS OF A RAPID-FIRING ORDNANCE PIECE

FIELD OF THE INVENTION

The present invention relates to a system for carrying out shelling of a target by means of a rapid-firing ordnance piece, for example cannon, howitzer or launcher for artillery missiles, with a number of ammunition units which can be fired successively one after the other. A system comprises maneuvering computer equipment which, as a function of input data, generates information for controlling of the ordnance piece and/or adjustment or fixing of one or more factors relating to flight parameter(s) of the respective ammunition unit. The factors can concern, for example, the launch speed or charge size, air resistance (coefficient) or brake function, etc.

BACKGROUND OF THE INVENTION

It is already known to use rapid-firing ordnance pieces, by means of which it is possible to shell a chosen target. The ordnance pieces can in this respect be of the type comprising elevatable and sideways-directable barrels. It is also known to provide control information to such ordnance pieces by means of computer-based equipment, to which various data, for example firing distance, launch speeds, wind information, and the like, can be introduced for giving control information corresponding to the desired and calculated parameters and firing conditions.

When shelling targets, it is most often desirable, from a tactical point of view, to achieve optimal surprise. The greatest possible surprise effect achieved if the ammunition units with which the target is to be shelled are included in one round, where the ammunition units or groups of ammunition units reach the target at essentially the same point in time. In this way the enemy does not have time, after the first shot, to prepare itself for subsequent shots in the round or group of ammunition units.

SUMMARY OF THE INVENTION

The present invention proposes a solution to the shortcoming of the prior art and the principal objective of the invention is that the controlling of the ordnance, piece and/or the ammunition units is coordinated. To accomplish this objective, the information output from the maneuvering equipment constitutes adjustment or selection information which allocates to the ammunition units different flight times between the ordnance piece and the target, so that they reach the target at essentially the same point in time after the launch from the ordnance piece.

The adjustment or selection information received from the maneuvering/computer equipment is preferably used for varying the angle of elevation of the ordnance piece, and in conjunction with this the adjustment or selection information can also affect or fix the various air resistance coefficients of the ammunition units.

In a second embodiment, the adjustment or selection information received from the equipment results in a simultaneous variation in the angle of elevation of the cannon and in the launch speeds of the shells.

In another embodiment the extracted information is used for altering the angle of elevation and the points in time for the start of extra braking of the shells or the like.

In a further embodiment, the launching speed of the ammunition units is the same, while the ordnance piece can be controlled within a predetermined range of elevation. The total firing time for the shelling of the target is comparatively long, and the information received from the equipment affects or fixes the trigger times for brake members on the ammunition units, which trigger times are in this case chosen to be different. In the case where the information from the equipment is used to control the launch speed/charge size instead of the trigger times of the brake members, the launch speeds can vary, for example, between 1000 m/s and 960 m/s in accordance with a predetermined pattern, which affords the desired simultaneity of impact on the target.

As regards the effect of the information received from the equipment on the elevation, this information preferably produces a continuous or step-wise dumping of the barrel of the ordnance piece from the highest to the lowest angle of elevation.

ADVANTAGES

By means of the present invention it is possible, with one and the same weapon, to achieve simultaneity in the impact of the shells or the like on a target. The shells which are launched first are caught up by the following shells before they reach the impact site. The invention can also be used in sideways-directable ordnance pieces where it is possible to combine simultaneity with desired strike patterns, that is the present invention can also be used on target patterns which have a relatively large spread purely in terms of area.

Preferred embodiments of a device having the features characteristic of the invention will be described below with reference to the attached drawing, in which

DETAILED DESCRIPTION OF THE PREFERRED EMBODIMENT(S)

Figure 1:
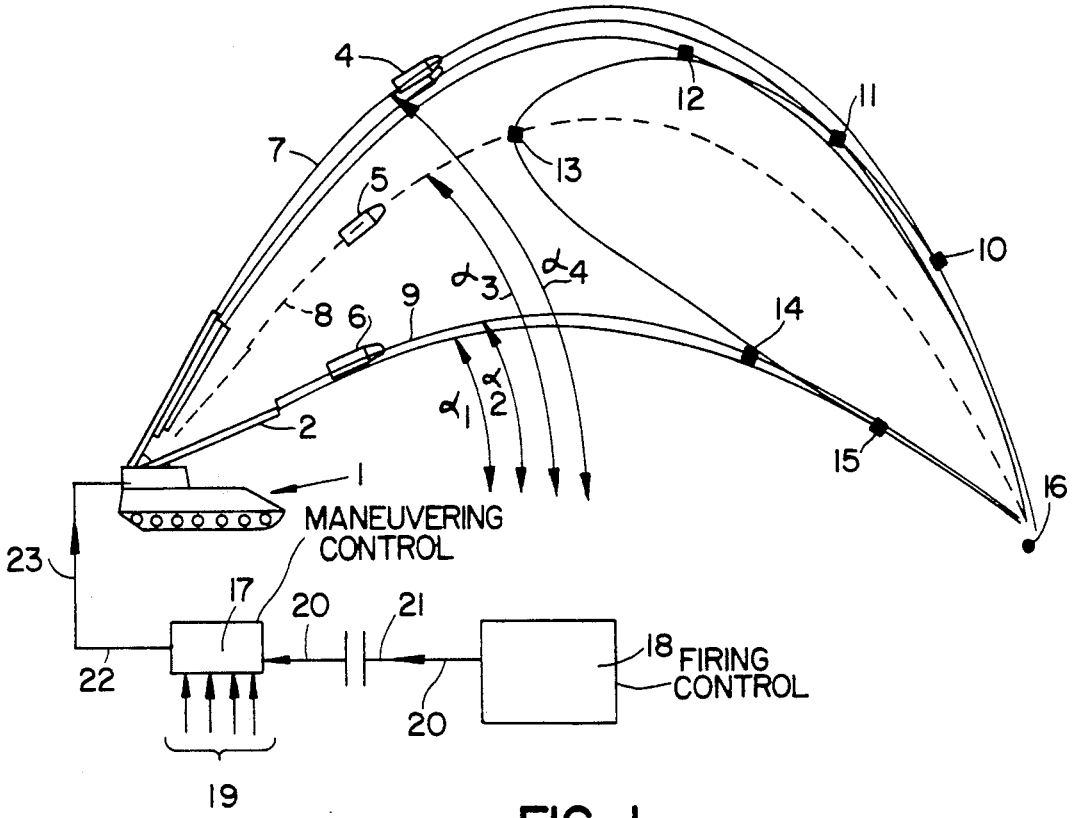
FIG. 1 shows, from the side, a caterpillar TM tracked ordnance piece where simultaneous impact of launched ammunition units/shells is achieved by means of variation in the barrel elevation and of different trigger times for extra brake members on the ammunition units/-shells.

In FIG. 1 a Caterpillar TM -tracked ordnance piece of known type is designated by 1. The ordnance piece has a large-bore barrel 2, for example 15.5 cm, which can be actuated in a known manner to different angles of elevation, of which some have been indicated by $\alpha 1$–$\alpha 4$. The ordnance piece is rapid-firing and can fire for example 6–10 shots/ min. The ordnance piece is also assumed to have magazines which permit long shooting rounds per total shooting times, for example rounds of up to 15 shots and shooting times of 35–60 sec.

In the embodiment of the present invention, according to FIG. 1, shells, for example 4, 5 and 6, are to be fired at different angles of elevation and follow different trajectories, for example trajectories 7, 8 and 9. In the case shown, the launch speed is the same for the various shells. In addition, in this embodiment, the shells are to be provided in a known manner with extra brake members, for example fold-out flaps or push-away tip hoods, which can be activated by fuses of known type. The fuses are activated in turn in connection with the launching of the respective shell from the barrel. The fuses are adjustable to different trigger times, after which the brake members are activated, calculated from the launching from the firing weapon. In the figure, points 10–15 on the various ballistic trajectories indicate the positions where the brake members of the shell are to be activated in order for the shells to strike essentially simultaneously one and the same target site 16.

An alternative method of achieving simultaneity in terms of the impact of the shells, with extra brake members which can be triggered by fuses, is to design the shells with individual air resistance (Cd).

A test in accordance with the above and relating to a distance of 30 km to the target has given the following results, where extra brake members with different trigger times were used:

| shot no. | elev. | time | start of braking |
|---|---|---|---|
| 1 | 62.8 | 0 | — |
| 2 | 59.6 | 6 | 17.5 |
| 3 | 56 | 12 | 15 |
| 4 | 52.4 | 18 | 14.6 |
| 5 | 48.6 | 24 | 15.6 |
| 6 | 44.2 | 30 | 19 |
| 7 | 40 | 36 | 60 |

In the test, a total of 7 shots were fired, as shown in the left-hand column. The range of elevation used was 62.8°–40°. The time interval between firing of the shots was 6 sec, and the points in time at which the brake members of the ammunition units were initiated in the different elevation trajectories, calculated from the launching time, are shown in the right-hand column. The 7 shots reached the target at 30 km simultaneously after the time period of 128 seconds from the launching moment. It is understood that a greater number of shots can be fired if, for example, a greater elevation range is used. Thus, for example, the elevation range 73°–17° can be used, in which respect the number of shots which instantaneously strike the target can be increased to about 30, or as many as the ordnance piece magazines contain. The last-mentioned example requires base-bleed shells at the proposed firing distance of 30 km.

A second test was carried out for the case in which the launch speed VO is varied.

| shot no. | elev. | time | $V_o$ |
|---|---|---|---|
| 1 | 62.8 | 0 | 1000 |
| 2 | 59.6 | 6 | 980 |
| 3 | 56 | 12 | 864 |
| 4 | 52.4 | 18 | 860 |
| 5 | 48.6 | 24 | 864 |
| 6 | 44.2 | 30 | 976 |
| 7 | 40 | 36 | 998 |

In this case also, 7 shots were fired in the round and the elevation range of 62.8°–40° was used. The firing interval between shots was 6 sec. The launch speeds varied between 1000 m/s and 960 m/s. The launch speed for the shells in the various trajectories was varied as shown in the right-hand column. These 7 shots also reached the target at 30 km simultaneously at time, after the time period of 128 sec.

It is possible to combine the functions of brake members with different trigger times and variable launch speeds/charge sizes.

The adjustment or fixing of the parameters of the shells, such as different trigger times for the shells, individual air resistance, different launch speeds VO (different charges) and the like can be determined using computer-based maneuvering equipment 17 which is included in or is connected to the ordnance piece 1. The equipment 17 can be connected to firing-control equipment 18. Data 19 relating to the present or coming shots is input to the equipment 17. The data can relate to the target distance, firing intervals, weather conditions, etc. Firing commands 20 can also be input to the equipment from the firing-control equipment 18. This input can be effected via a wireless or fixed connection 21.

The maneuvering equipment is designed in a known manner to process such incoming data 19 and firing commands 20. The maneuvering equipment outputs at its output 22 control information 23 to the barrel-controlling member/or shell-advancing member and/or shell-actuating member and/or shell function-selecting member etc. of the ordnance piece 1. The control information 23 is used as adjustment or selection information which allocates or indicates the different parameters for the members listed above which afford the desired simultaneity of impact of the shells on the target. One or more parameters, for example, the firing interval, can be built into the function of the Caterpillar TM -tracked ordnance piece. In the case with elevation variation, the firing preferably begins at the highest elevation, after which the barrel is dumped continuously or stepwise during the continued firing. Such a function can also be built into the ordnance piece and does not need to be controlled, but instead, for example, only selected among other possible elevation or dumping cases.

Figure 2:
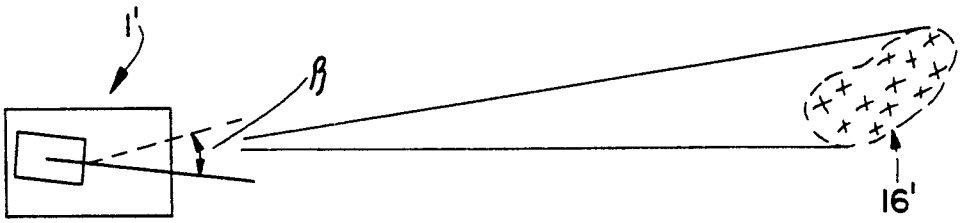
FIG. 2 shows, form above, a sideways-directable Caterpillar TM tracked ordnance piece where scattering of the target pattern in side and length can be carried out.

FIG. 2 shows that a used Caterpillar TM -tracked ordnance piece 1' is designed with a sideways-directable function, in which respect the total sideways-directable angle has been indicated by $\beta$.

As a result of elevation and sideways variations, it is possible to achieve a specific desired scattering for the target image 16'. A characteristic feature of the firing case according to FIG. 2 is again the simultaneity of the impact of the shells.

The invention is not limited to the embodiment shown above by way of example, but instead can be subject to modifications within the scope of the following patent claims and the inventive concept.

I claim:

1. A method for carrying out shelling of a target with a plurality of ammunition units fired successively from a single barrel rapid-firing ordnance piece, said method comprising the steps of:

1) supplying data to a computer means regarding the target to be shelled;

2) generated by said computer means in response to said input data, an output data for controlling at least one of the following:

a) the ordnance piece and b) the flight parameters of the respective ammunition units;

3) coordinating controlling of the ordnance piece and the ammunition units while firing of the successive ammunition unit from said single barrel ordnance for imparting to the ammunition units different flight times between the ordnance piece and the target, and 4) selecting said different flight times such that said successively fired ammunition units reached the target at approximately the same time after the launch from the ordnance piece.

2. A method according to claim 1, further including the step of controlling aiming of the ordnance piece by variation of the angle of elevation of the barrel of the ordnance piece during the shelling based on said output data from said computer means.

3. A method according to claim 1, further including the step of controlling the successive ammunition units before or during the shelling for achieving different coefficients of drag for the ammunition units.

4. A method according to claim 1, further including the step of controlling of one or more ammunition units before or during the shelling for effecting or adjusting triggerable brake members or extra braking on the respective ammunition unit.

5. A method according to claim 1, further including the step of controlling said ordnance piece during the shelling by providing predetermined firing intervals between shots.

6. A method according to claim 1, wherein the ordnance piece can be controlled within a predetermined elevation range between 63° to 40°, wherein the total firing time for the shelling of the target is comparatively long, about 35 seconds, and wherein the launch speeds and charge size are varied or selected, which launch speeds can vary between 1000 m/s to 960 m/s in accordance with a predetermined pattern, which gives the desired simultaneous impact on the target.

7. A system for carrying out shelling of a target with a plurality of ammunition units fired successively from a single barrel rapid-firing ordnance piece, said system comprising:

1) means for supplying data to a computer means regarding the target to be shelled;
2) computer means for generating in response to said input data, an output data for controlling at least one of the following:
   a) the ordnance piece and
   b) the flight parameters of the respective ammunition units;
3) said computer means coordinating controlling of the ordnance piece and the ammunition units during firing of the successive ammunition unit from said single barrel ordnance for imparting to the ammunition units different flight times between the ordnance piece and the target, said different flight times being selected such that said ammunition units reach the target at approximately the same time after the launch from the ordnance piece.

8. A system according to claim 7, wherein during the shelling, the computer equipment provides input data for controlling aiming of the ordnance piece by variation of the angle of elevation of the barrel of the ordnance piece.

9. A system according to claim 7, wherein the successive ammunition units are controlled before or during the shelling for achieving different coefficients of drag for the ammunition units.

10. A system according to claim 7, wherein one or more ammunition units are controlled for effecting or adjusting triggerable brake members or extra braking on the respective ammunition unit before or during the shelling.

11. A system according to claim 7, wherein during the shelling, said output data from said computer means controls said ordnance piece by providing predetermined firing intervals between shots.

12. A system according to claim 7, wherein the charges of the ammunition units are selected by said computer means.

13. A system according to claim 7, wherein the ammunition units are launched at the same launch speed and wherein the ordnance piece is controlled within a predetermined elevation range, wherein the total firing time for the shelling of the target is comparatively long, about 35 seconds, and wherein the brake members on the ammunition units are adjusted in advance or during flight for triggering.

14. A system according to claim 7, wherein during the shelling said ordnance piece is controlled for allowing continuous or stepwise dumping of the barrel of the ordnance piece from the highest to the lowest angle of elevation.

15. A system according to claim 7, wherein during shelling a continuous or step-wise sideways variations of direction of the barrel of the ordnance piece are effected in order to providing, during the simultaneous impacts of the ammunition units on the target, a scattering or desired target pattern, dependent on the variation in the sideways direction.

16. A system for carrying out shelling of a target including in combination a single barrel large caliber ordnance piece and means for controlling the firing of a plurality of ammunition units in succession over a period of time from said single barrel and/or controlling flight parameters of ammunition units so that said successive ammunition units reach the target at approximately the same time, said controlling means comprising a computerized equipment for controlling at least one of the following:

a) means for effecting the aiming of the ordnance piece; and
b) means for varying the flight parameters for the successive ammunition units.

17. A system according to claim 16, wherein during the shelling, the computer equipment provides input data for controlling aiming of the ordnance piece by variation of the angle of elevation of the barrel of the ordnance piece.

18. A system according to claim 16, wherein the successive ammunition units are controlled for achieving different coefficients of drag for the ammunition units before or during the shelling.

19. A system according to claim 16, wherein one or more ammunition units are controlled for effecting or adjusting triggerable brake members or extra braking on the respective ammunition unit before or during the shelling.

20. A system according to claim 16, wherein during the shelling, said output data from said computer means controls said ordnance piece by providing predetermined firing intervals between shots.

* * * * *